US005193797A

United States Patent [19]

Harada et al.

[11] Patent Number: 5,193,797

[45] Date of Patent: Mar. 16, 1993

[54] PAPER FEEDING SYSTEM AND PICKING SYSTEM USED THEREFOR

[75] Inventors: Hiroyuki Harada; Akio Tajima; Fumio Otsuka, all of Tokyo, Japan

[73] Assignee: Seikosha Co., Ltd., Tokyo, Japan

[21] Appl. No.: 769,096

[22] Filed: Sep. 30, 1991

[30] Foreign Application Priority Data

Oct. 5, 1990 [JP] Japan ..... 2-267848
May 21, 1991 [JP] Japan ..... 3-35932[U]

[51] Int. Cl.[5] ..... B65H 3/06

[52] U.S. Cl. ..... 271/115; 271/118; 271/127

[58] Field of Search ..... 271/115, 116, 117, 118, 271/126, 127, 169, 170

[56] References Cited

U.S. PATENT DOCUMENTS

| | | | |
|---|---|---|---|
| 3,815,900 | 6/1974 | Setulze | 271/118 |
| 4,900,003 | 2/1990 | Hashimoto | 271/118 |
| 4,934,686 | 6/1990 | Ono | 271/118 |
| 5,052,673 | 10/1991 | Tokuda et al. | 271/117 |

*Primary Examiner*—H. Grant Skaggs
*Attorney, Agent, or Firm*—Jordan and Hamburg

[57] ABSTRACT

A paper feeding system that eliminates a mechanism for interrupting driving force to picking rollers to lower the cost of the system and to secure the feeding of papers. Corner nails are supported in a manner displacable up and down on the both sides of the front end portion of a paper cassette and the front corner portions of papers stored within the paper cassette can be anchored by the corner nails. A projecting part of the corner nails abuts to a stopper to restrict its upper limit position. When the paper is not fed, the picking rollers are in an up position and are separated from the paper and the corner nails retain the paper at a certain height position engaging with the front corner portion of the paper. When the paper is fed, the picking rollers go down to a down position to press the paper against biasing force of a bias spring and the corner nails are separated from the stopper and contact with the front corner portion of the paper in the down position.

6 Claims, 17 Drawing Sheets

PAPER FEEDING SYSTEM AND PICKING SYSTEM USED THEREFOR

BACKGROUND OF THE INVENTION

1. Field of the Invention

The present invention relates to a paper feeding system and picking system used therefor used in a printer and others.

2. Description of the Related Art

In the prior art paper feeding system of a printer, a picking roller for feeding paper one by one is rotationally driven by receiving driving force of a motor that simultaneously drives a feed roller and a discharge roller and always abuts with paper. Due to that, when the paper is not fed, the rotation of the picking roller has to be stopped, and to that end, an electromagnetic clutch is provided in the middle of transmission of the driving force from the motor to the picking roller to be able to transmit or to interrupt the driving force. A corner nail installed in a fixed manner also engages with the front corner portion of the paper placed on a hopper plate biased upwardly by biasing means.

Accordingly, there has been problems in the prior art that its structure became complex and it was expensive because the mechanism of electromagnetic clutch and others for controlling transmission or interruption of the driving force were necessary. Moreover, there has been such a problem that because the corner nail installed in a fixed manner engages with the corner of the paper, the surface of the corner of the paper is pressed by the corner nail and the paper cannot curl easily when the paper is fed by being separated one by one. Hence such problems that the feeding becomes insecure, the paper cannot be easily disengaged from the corner nail even if it curled, the curling becomes unnecessarily large and a large space for the curling at the top and bottom has to be taken were brought about.

On the other hand, in printer and copier systems, a picking system is installed by which the top paper is taken out from the paper holder like a paper cassette and is sent to the printing section by conveyer rollers and the like.

In the publicly known picking system, the picking roller is generally adapted to transmit or interrupt driving force from a driving means by an electromagnetic clutch.

However, the picking system as mentioned above had such problems that its production cost is high since it needs the electromagnetic clutch and that because the picking roller always abuts to paper in the paper holder, the picking roller becomes a drag in conveying the paper when the rotation of the picking roller is stopped after the paper is taken out of the paper holder.

Accordingly, a general object of the present invention is to eliminate the mechanism for interrupting the driving force for the picking roller to allow to lower the cost of the feeding system and to secure feeding of papers.

Another object of the present invention is to provide a picking system in which a picking roller abuts to paper only when the paper is taken out of the paper holder.

SUMMARY OF THE INVENTION

In order to achieve the aforementioned objects, the paper feeding system of the present invention is comprised of:

a paper cassette for storing papers;

a hopper plate on which papers are placed and which is installed in the paper cassette in a manner movable up and down;

biasing means for biasing the hopper plate upwardly;

corner nails provided at the both sides of the front of the paper cassette in a way they engage with the front corners of papers to hold the top paper at a certain height when it is not fed and to separate the top paper when it is to be fed; and picking rollers installed above the paper cassette in a manner movable up and down which go up to a position where the rollers are separated from the top paper when the paper is not fed and which go down to a position where the rollers press the top paper against biasing force of the biasing means when the paper is fed.

Moreover, in order to achieve the aforementioned objects, the picking system of the present invention is comprised of:

a lever for supporting the picking rollers and which is supported in a displacable manner;

a cam wheel having a cam means to engage with a cam follower provided on the lever to displace the lever to displace the picking rollers to a first position where the rollers are separated from the paper and a second position where the rollers abut to the paper;

driving means capable of rotating in normal and reverse directions for rotating and displacing the picking rollers; and clutching means for transmitting the rotation of the driving means only by a certain rotation angle;

the cam means being comprised of a main cam which is comprised of a cam surface that maintains the picking rollers at the first position and a recess that allows the picking rollers to be displaced to the second position and an auxiliary cam that allows the cam follower to fall from the cam surface to the recess when the driving means is normally rotated, but that prevents the cam follower from falling from the cam surface to the recess when the driving means is reversely rotated.

According to the paper feeding system structured as described above, the picking rollers are separated from the paper except the time when the paper is fed and the paper is anchored by the corner nails and is maintained at a certain height position. Moreover, when the paper is fed, the picking rollers come down to a position where they press the paper, causing the corner nails to be just lightly placed on the paper.

Furthermore, according to the picking system structured as described above, the picking rollers are displaced to the first position where the rollers are separated from the paper and to the second position where the rollers abut to the paper by the rotation of the cam wheel which is caused when the cam means of the cam wheel engages with the cam follower of the lever. The rotation and displacement of the picking rollers are caused by the normal and reverse rotation of the driving means and the rotation of the driving means is transmitted to the cam wheel only by a certain rotation angle. Then the picking rollers are displaced to the second position where the rollers abut to the paper only for a certain period of time in the initial period of the normal rotation time of the driving means by the action played by the auxiliary cam and are retained in the first position where the rollers are separated from the paper during when the driving means is reversed.

Accordingly, the paper can be taken out by abutting to the picking rollers while the rollers are rotated for a certain period of the initial time during the normal rotation of the driving means. And after the paper has been taken out, the picking rollers are separated from the paper and the condition is maintained even if the driving means continues to normally rotate. Therefore, the picking rollers would not become a drag in conveying the paper.

BRIEF DESCRIPTION OF THE DRAWINGS

The preferred embodiment of the present invention will now be described with reference to the accompanying drawings wherein.

DETAILED DESCRIPTION OF PREFERRED EMBODIMENT

Figure 1:
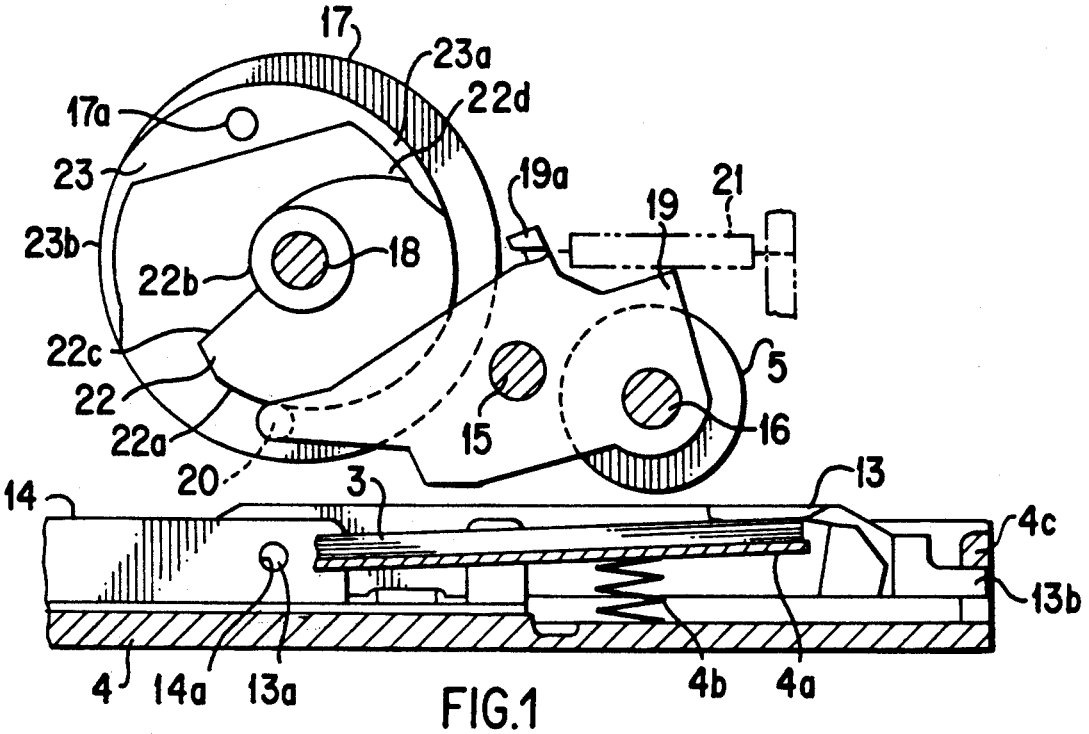
FIG. 1 is a sectional view showing the main part of one embodiment of the present invention when paper is not fed.

Referring now to the drawings, one preferred embodiment of the paper feeding system of the present invention is explained in detail.

Figure 3:
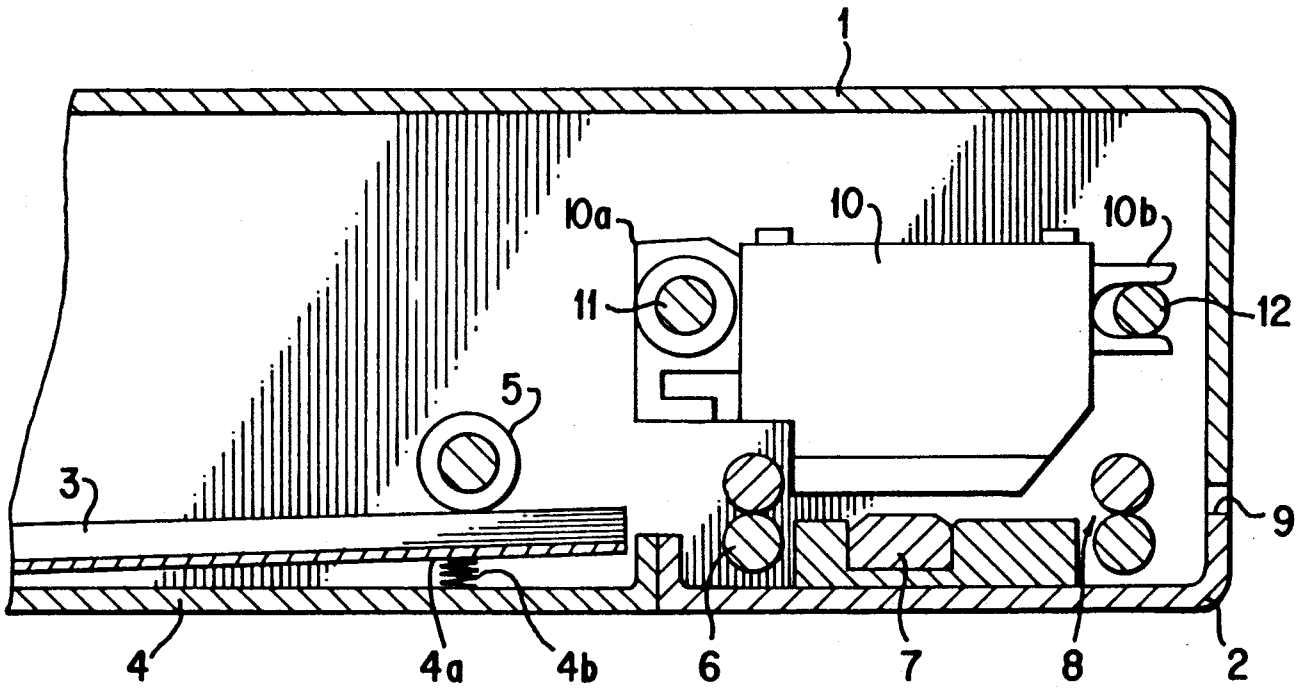
FIG. 3 is a sectional view of the main part of a printer to which the paper feeding system of the present invention is applied.

Referring first to FIG. 3, an outline structure of a printer on which the paper feeding system of the present invention is applied is explained. An printer case is comprised of an upper case 1 whose upper face is flat and a lower case 2 and a paper cassette 4 for storing papers 3 is provided at the rear bottom portion of the lower case 2. The papers 3 are stacked on a hopper plate 4*a* which is provided at the front bottom part of the paper cassette 4 in a manner movable up and down by being biased upwardly by an biasing means 4*b*.

Figure 2:
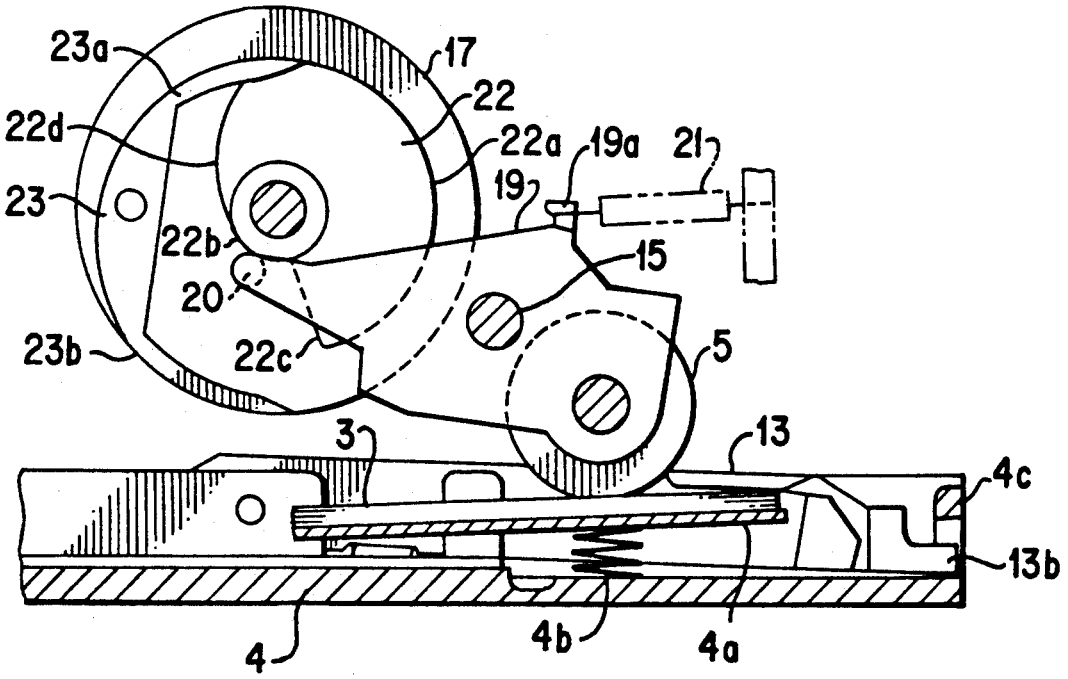
FIG. 2 is a sectional view showing the same main part in FIG. 1 when the paper is fed.

A picking roller 5 is positioned above the paper 3. The picking roller 5 drops down to the position where it presses the top paper 3 when the paper is fed by an elevating means described later (as shown in FIG. 2) and rises to the position where it is separated from the paper 3 when the paper is not fed (as shown in FIG. 1). A feed roller 6, a platen 7 and a discharge roller 8 are disposed at the front of the paper cassette 4 to discharge the paper from a discharge port 9 between the upper case 1 and the lower case 2. A printing head 10 is disposed above the platen 7 facing thereto.

A printing wire impact type printing head is used for the printing head 10. A slider 10*a* is fixed to and a receiving part 10*b* is formed in one body with the head 10, causing it movable along guide shafts 11 and 12 while keeping the printing section downwardly.

As shown in FIGS. 1 and 2, the front edge corner of the paper 3 can be anchored by corner nails 13. That is, metal side plates 14 are standing in the longitudinal direction accommodating to width of the paper 3 within the the paper cassette 4. A hole 14*a* is created at the front portion (right edge portion) of the metal side plate 14 and by engaging with a pin 13*a* provided on the corner nail 13 that is located at the both sides of the front of the paper cassette 4, the front edge portion of the corner nail 13 is supported in a manner displacable up and down. A projecting part 13*b* is projected forwardly from the front edge portion of the corner nail 13 and by abutting the projecting part 13*b* to a stopper 4*c* provided at the front of the paper cassette 4, the upper limit of the corner nail 13 is restricted. Moreover, when the picking roller 5 goes up when the paper is not fed, the corner nail 13 engages with the front edge corner of the paper 3 (as shown in FIG. 1) and retains the paper 3 at a certain height position.

Next, a means to elevate and rotate the picking roller 5 shown in FIGS. 1 and 2 is explained.

A driving shaft 15 is driven and rotated clockwise by a motor (not shown) and the rotation is transmitted to a roller shaft 16 of the picking roller 5 through a transmitting gear train (not shown) to rotate the picking roller 5 counter-clockwise. The rotation of the driving shaft 15 is also transmitted to a rotating shaft 18 of a cam wheel 17 through another transmitting gear train (not shown) to rotate the cam wheel 17 counter-clockwise. A spring clutch (not shown) that transmits the rotation of the rotating shaft 18 to the cam wheel 17 by a certain rotation angle is provided between the cam wheel 17 and the rotating shaft 18. A lever 19 is swingably supported centered on the driving shaft 15. The roller shaft 16 rotatably penetrates through one end portion (right edge portion) of the lever 19 and a cam follower 20 is provided at the other end portion (left edge portion). A tension spring 21 is hooked to a hook 19*a* which is formed in one body with the lever 19 and biases a turning force clockwise on the lever 19.

A main cam 22 is created in one body with the cam wheel 17 and the cam follower 20 can follow the main cam 22 by the biasing force of the tension spring 21. The main cam 22 has a profile having a cam surface 22*a* and a recess 22*b* and the picking roller 5 is separated from the top paper 3 in the state when the cam follower 20 rides on the cam surface 22*a* (as shown in FIG. 1). In the state when the cam follower 20 falls from the cam surface 22*a* to the recess 22*b*, the picking roller 5 presses the top paper 3 against the biasing means 4*b* (as shown in FIG. 2). The boundary of the cam surface 22*a* and the recess 22*b* is created to be a falling edge 22*c* at one side and an easy sloped edge 22*d* at the other side.

An auxiliary cam 23 is swingably pivoted to the cam wheel 17 at the recess 22*b* side of the main cam 22 through the pin 17*a*. The auxiliary cam 23 has an arc shape and a pair of arms 23*a* and 23*b* are created at the both sides of the center of the swing. The auxiliary cam 23 is biased clockwise around the pin 17*a* by a tension spring (not shown) and by the biasing force, normally one arm 23*a* is abutted so that it lies in row with the upper face of the cam surface 22*a* at the easy sloped edge 22*d* side and the cam follower 20 is prevented from falling from the cam surface 22*a* to the recess 22*b* at the easy sloped edge 22*d* side. In the state when the arm 23*a* abuts with the upper face of the cam surface 22*a* at the easy sloped edge 22*d* side, the arm 23*b* is positioned above the cam surface 22*a* at the falling edge 22*c* side, so that the cam follower 20 can fall from the cam surface 22*a* to the recess 22*b* along the falling edge 22*c* through between the arm 23*b* and the cam surface 22*a*. When the lower case 23 is swung counter-clockwise around the pin 17*a*, the arm 23*b* is abutted to the upper face of the cam surface 22*a* at the falling edge 22*c* side and the cam follower 20 is prevented from falling from the cam surface 22*a* to the recess 22*b* along the falling edge 22*c*.

In operation, the cam follower 20 rides on the cam surface 22*a* of the main cam 22 and the picking roller 5 is separated from the top of the paper 3 in the initial state. The corner nail 13 is biased by the biasing means 4*b* and is pushed up to the upper limit position restricted by the stopper 4*c* to hold the paper 3 at a certain height position. Accordingly, the distance between the top paper 3 and the picking roller 5 is always constant regardless of the amount of the paper 3 left during when the paper is not fed.

When a feed signal arrives, the driving shaft 15 is driven to rotate the cam wheel 17 and the picking roller 5. By the rotation of the cam wheel 17, the cam follower 20 falls from the cam surface 22*a* to the recess 22*b* along the falling edge 22*c* as shown in FIG. 2, the lever 19 swings clockwise and the picking roller 5 drops and presses the top paper 3 against the biasing force of the biasing means 4*b*. That is, the biasing force of the biasing means 4*b* is compressed by the picking roller 5, so that the hopper plate 4*a* drops and the corner nail 13 slightly drops separating from the stopper 4*c* and just contacts to the front edge corner of the top paper 3 by its own weight. Then, when the top paper 3 is fed in the right direction by the counter-clockwise rotation of the picking roller 5 transmitted from the driving shaft 15, the front edge corner of the paper 3 that engaged with the corner nail 13 easily curls and by the curling force, the corner nail 13 is slightly pushed up and only one sheet of the paper 3 is securely separated and fed.

When the sheet of the paper 3 is fed by the picking roller 5, the cam follower 20 goes up from the recess 22*b* to the cam surface 22*a* along the easy sloped edge 22*d* by the rotation of the cam wheel 17, pushes up the arm 23*a* against its biasing force to reach to the cam surface 22*a* and swings the lever 19 counter-clockwise to bring up the picking roller 5 to the upper position and to return to the state of FIG. 1. After that, the discharge roller 8 runs idle against the cam wheel 17 by the effect of the clutch spring and the state of FIG. 1 is maintained.

Although the picking roller 5 is brought up and down using the cam mechanism in the aforementioned embodiment, the picking roller 5 may be brought up and down using other mechanism, not just by the cam mechanism.

Next, referring now to the drawings, one embodiment of the picking system of the present invention is explained in detail.

At first, a printer to which the picking system of the present invention is applied is briefly explained.

Figure 6:
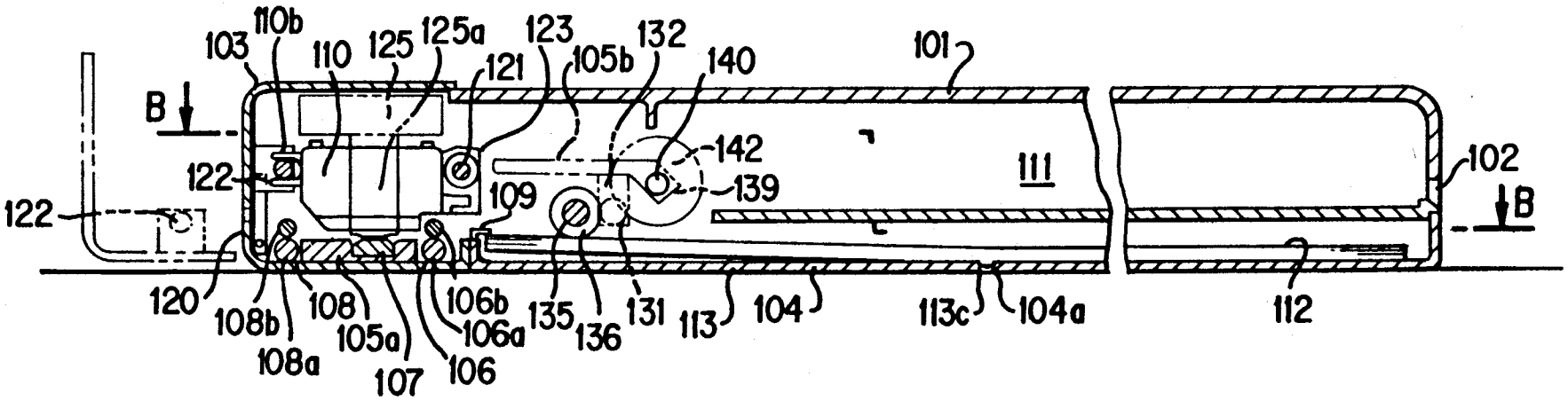
FIG. 6 is a vertical sectional view of a printer to which the picking system of the present invention is applied.

In FIG. 6, a printer case is comprised of an upper case 101, a lower case 102 and a cover 103 at the front portion and its outside view is a flat box type shape whose upper face is flat.

A box type paper cassette 104 whose upper face is opened is mounted at the rear bottom side of the lower case 102 from the right direction in FIG. 6. A circuit block containing a printed wiring board in which a drive control circuit is built in is disposed at a space 111 above the paper cassette 104.

In the paper cassette 104, a plurality of papers 112 is stacked from the opening of the upper face. A hopper plate 113 is mounted at the front bottom part of the paper cassette 104 (see FIG. 7). The hopper plate 113 has a T-shaped planar shape and is pivoted in the state when an end portion 113*c* thereof is engaged to a hole 104*a* opened on the paper cassette 104 and is swingable centering on the end portion. Below the hopper plate 113, a biasing means for biasing the front portion of the hopper plate 113 upwardly is provided (not shown) and by the biasing means, the hopper plate 113 is pushed up to press the front edge corner of the paper 112 to corner nails 109 at both sides of the front edge portion of the paper cassette 104.

A frame 105*a* is fixed to the bottom of the lower case 102 at the front of the paper cassette 104 and a platen 107 is mounted to the frame 105*a*. The platen 107 is disposed in the left and right directions turning up its abutting face with the paper 112.

Before and after the platen 107, a feed roller 106 and a discharge roller 108 are mounted to the frame 105*a* in parallel with the platen 107. Both the feed roller 106 and the discharge roller 108 are comprised of driving rollers 106*a* and 108*a* at the lower side and pinch rollers 106*b* and 108*b* at the upper side. The driving rollers 106*a* and 108*a* are driven and rotated by a normal-reverse rotation motor 116 (shown in FIG. 7) through an intermediary of a gear train (not shown). A discharge port 120 is created on the lower case 102 at the front of the discharge roller 108 and the height of the discharge port 120 is approximately same with the height of abutting face of the driving roller 108*a* and the pinch roller 108*b* of the discharge roller 108.

A printing head 110 is disposed above the platen 107 facing thereto. A printing wire impact type head is used for the printing head 110 in this embodiment. A slider 123 is fixed to and a receiving part 110*b* is created in one body with the printing head 110 to allow to move it along the guide shafts 121 and 122 through the intermediary of the slider 123 and the receiving part 110*b*, keeping the printing section downwardly. The printing head 110 can be reciprocated by a carriage motor (not shown) through an intermediary of a timing belt (not shown). The guide shaft 122 is fixed to the cover 103 and the receiving part 110*b* can be opened to the side, so that the guide shaft 122 can be removed from the receiving part 110*b* when the cover 103 is opened.

A ribbon cassette 125 is disposed above the printing head 110. The ribbon cassette 125 has arms 125*a* at the both sides and an ink ribbon exposed from between both arms 125*a* is disposed between the platen 107 and the printing head 110. The ribbon cassette 125 is attached by opening the cover 103. The ribbon cassette 125 is also driven by the carriage motor through intermediary of a gear train (not shown).

Next, the picking system is explained.

Figure 7:
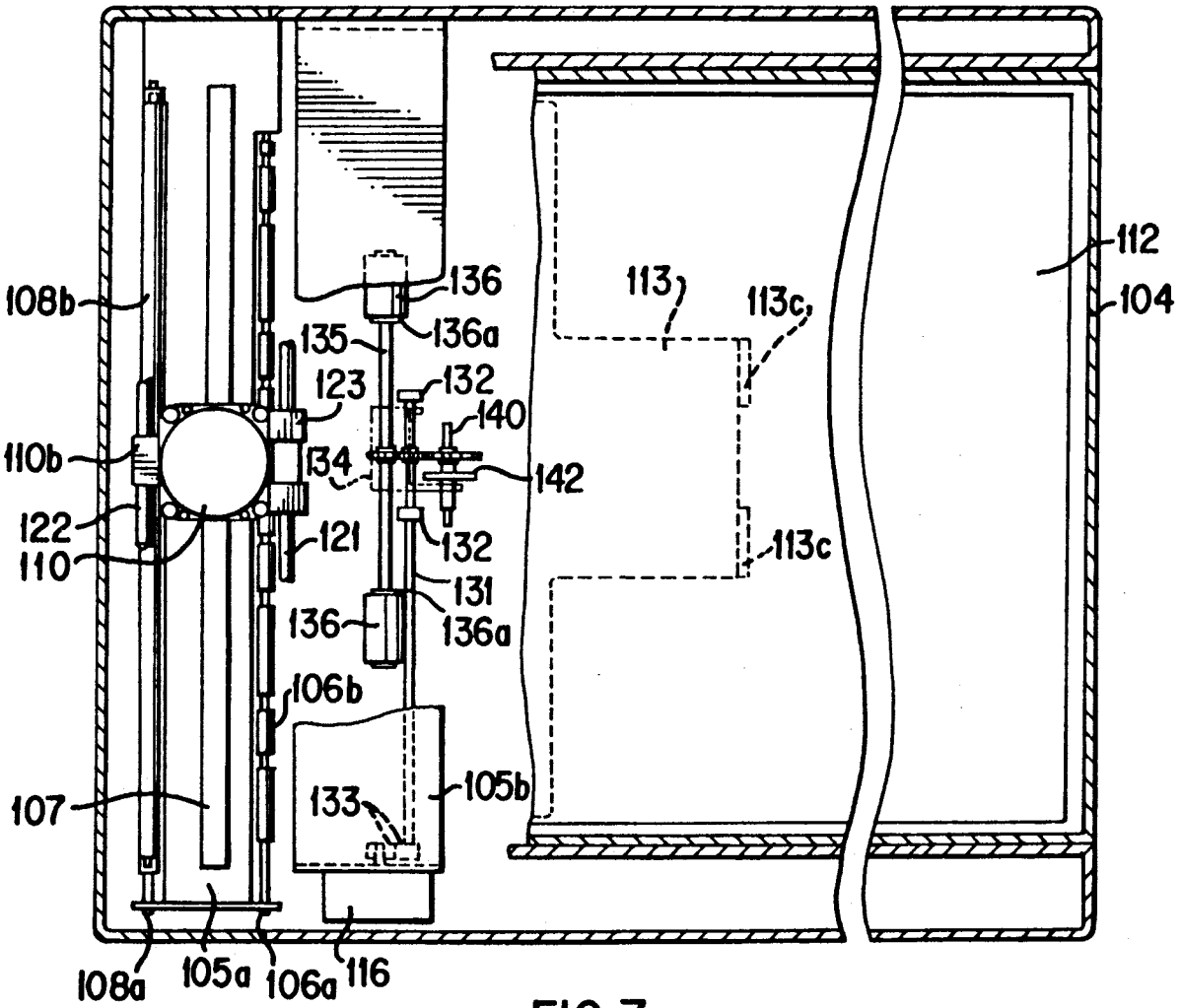
FIG. 7 is a sectional view taken along like B—B in FIG. 6.

As shown in FIG. 7, the normal-reverse rotation motor 116 is mounted at the right edge portion of the frame 105*b*. The frame 105*b* is fixed to the bottom of the lower case 102.

Figure 4:
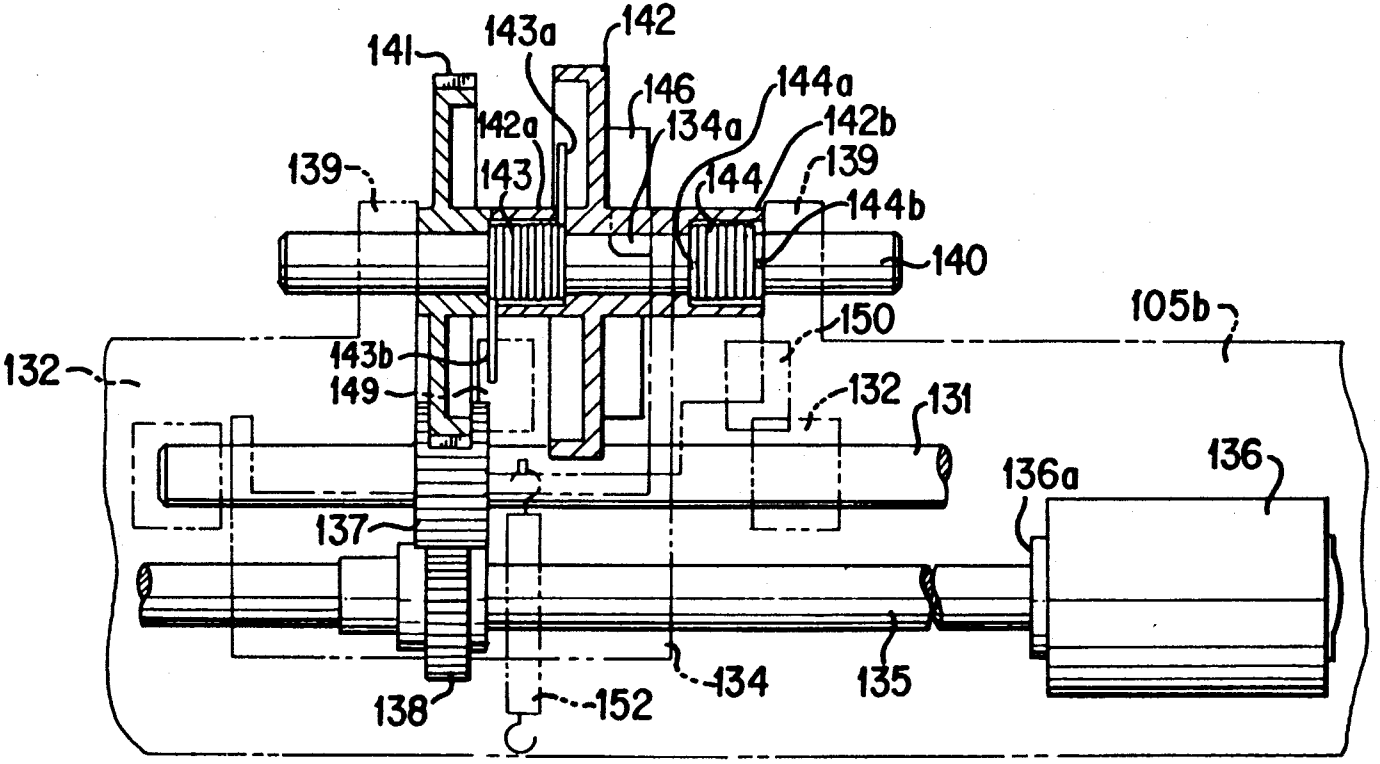
FIG. 4 is a plan view of one embodiment of the picking system of the present invention.
Figure 5:
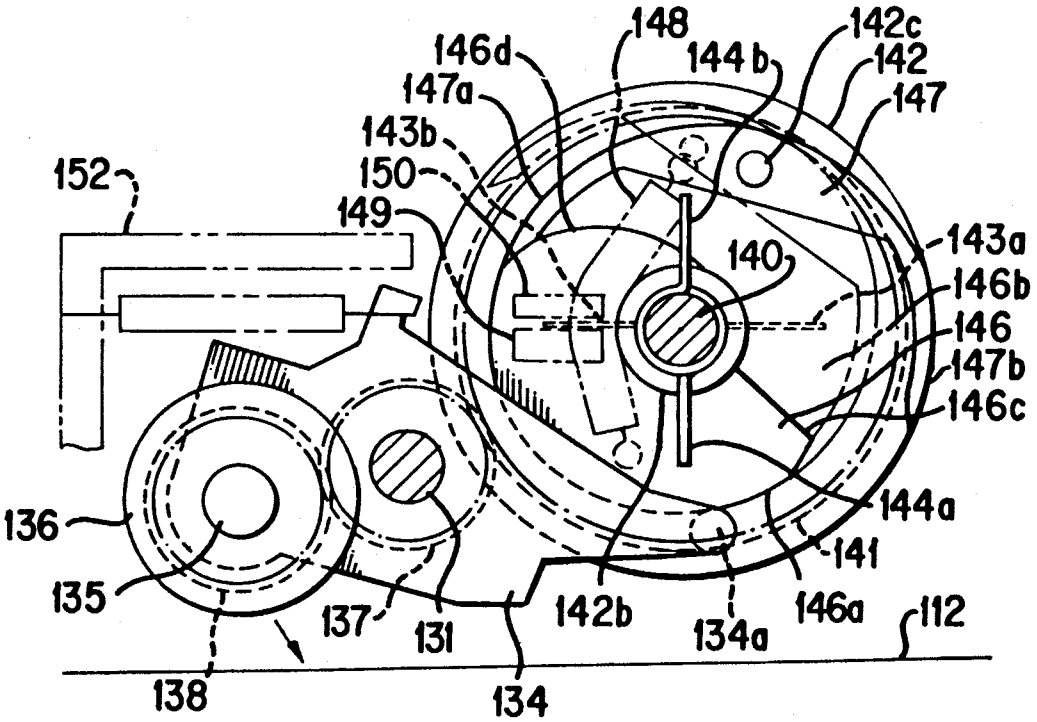
FIG. 5 is a right side view of the picking system of FIG. 4.

A driving shaft 131 is connected to the normal-reverse rotation motor 116 through an intermediary of a gear train 133. The driving shaft 131 is pivoted in a manner rotatable below the frame 105*b*. As shown in FIGS. 4 and 5, a lever 134 is rotatably pivoted to the driving shaft 131 and the lever 134 is biased counter-clockwise in FIG. 5 around the driving shaft 131 by a tension spring 152.

A cam follower 134*a* is provided at one end side of the lever 134 and a roller shaft 135 is rotatably pivoted at the other side of the lever 134. The roller shaft 135 and the driving shaft 131 are engaged through gears 137 and 138 fixed to them and are driven and rotated by the driving force of the normal-reverse rotation motor 116. Picking rollers 136 are mounted to the both sides of the roller shaft 135. There exists an one-way clutch 136*a* between the picking roller 136 and the roller shaft 135 to transmit the driving force of the roller shaft 135 to the picking roller 136 to rotate it when the roller shaft 135 is rotated clockwise in FIG. 5, and not to transmit the driving force of the roller shaft 135 to the picking roller 136 when the roller shaft 135 is rotated counter-clockwise in FIG. 5.

On the other hand, a pair of bearings 139 project out from the frame 105*b* at the opposite side of the roller shaft 135 centered on the driving shaft 131 and a rotating shaft 140 is pivoted to the pair of gears 139 in a manner freely rotatable. A gear 141 is fixed to the rotating shaft 140 and by engaging with the gear 137, is driven and rotated by the driving force of the normal-reverse rotation motor 116.

A cam wheel 142 is mounted to the rotating shaft 140 in a manner relatively rotatable. Sleeves 142*a* and 142*b* are created at the center of the cam wheel 142 and clutch springs 143 and 144 are wound to the rotating shaft 140 inside of the sleeves 142*a* and 142*b* by a certain friction force. A long groove (see FIG. 4) is created in the sleeves 142*a* and 142*b* in the shaft direction and one end portions 143*a* and 144*a* of the clutch springs 143 and 144 are anchored to the long groove. The winding direction of the clutch springs 143 and 144 are the same, so that the clutch spring 143 is wound up when the rotating shaft 140 is rotated counter-clockwise in FIG. 5 and the cam wheel 142 is rotated together with the rotating shaft 140 and the clutch spring 144 is wound up when the rotating shaft 140 is rotated clockwise in FIG. 5 and the cam wheel 142 is rotated together with the rotating shaft 140. Moreover, grooves in the peripheral direction (not shown) are created at the end of the sleeves 142*a* and 142*b* and the other end portions 143*b* and 144*b* of the clutch springs 143 and 144 are projected from the inside of the sleeves 142*a* and 142*b* toward outside through the grooves in the peripheral direction.

A main cam 146 is created in one body with the cam wheel 142 at the right side thereof as shown in FIG. 4 and the cam follower 134*a* of the picking roller 136 can follow the main cam 146 by biasing force of a tension spring 152. A profile of the main cam 146 is comprised of a cam surface 146*a* and a recess 146*b* as shown in FIG. 5 (FIGS. 8 through 12) and in the state when the cam follower 134*a* rides on the cam surface 146*a*, the picking roller 136 is separated from the top paper 112. Also in the state when the cam follower 134*a* falls from the cam surface 146*a* to the recess 146*b*, the picking roller 136 abuts to the top paper 112. The boundary of the cam surface 146*a* and the recess 146*b* is created to be a falling edge 146*c* at one side and to be an easy sloped edge 146*d* at the other side.

An auxiliary cam 147 is swingably pivoted to the cam wheel 142 at the recess 146*b* side of the main cam 146 through an intermediary of pins 142*c* (see FIG. 5 and FIGS. 8 through 12, not shown in FIG. 4). The auxiliary cam 147 has an arc shape and a pair of arms 147*a* and 147*b* are created at the both sides centered on the center of the swing. The auxiliary cam 147 is biased counter-clockwise in FIG. 5 around the pins 142*c* by a tension spring 148 and by the biasing force, normally one arm 147*a* abuts so that it lies in row with the upper face of the cam surface 146*a* at the easy sloped edge 146*d* side and the cam follower 134*a* is prevented from falling from the cam surface 146*a* to the recess 146*b* at the easy sloped edge 146*d* side. Moreover, in the state when the arm 147*a* abuts to the upper face of the cam surface 146*a* at the easy sloped edge 146*d* side, the arm 147*b* is positioned above the cam surface 146*a* at the falling edge 146*c* side and the cam follower 134*a* can fall from the cam surface 146*a* to the recess 146*b* along the falling edge 146*c* through between the arm 147*b* and the recess 146*b*. Moreover, when the auxiliary cam 147 is swung clockwise in tension spring 148, the arm 147*b* can abut to the upper face of the cam surface 146*a* at the falling edge 146*c* side.

On the frame 105*b*, stoppers 149 and 150 are created in a manner capable of abutting with end portions 143*b* and 144*b* of the clutch springs 143 and 144 by the rotation of the cam wheel 142. The end portion 143*b* of the clutch spring 143 abuts to the stopper 149 from above and the end portion 144*b* of the clutch spring 144 abuts to the stopper 150 from below. In the present embodiment, the position relationship of the end portions 143*b* and 144*b* of the clutch springs 143 and 144 and the stoppers 149 and 150 are set so that when the cam wheel 142 rotates about 270 degrees from the state when the one end portion of the clutch spring abuts with one stopper, the other end portion of the clutch spring abuts to the other stopper.

Figure 8A:
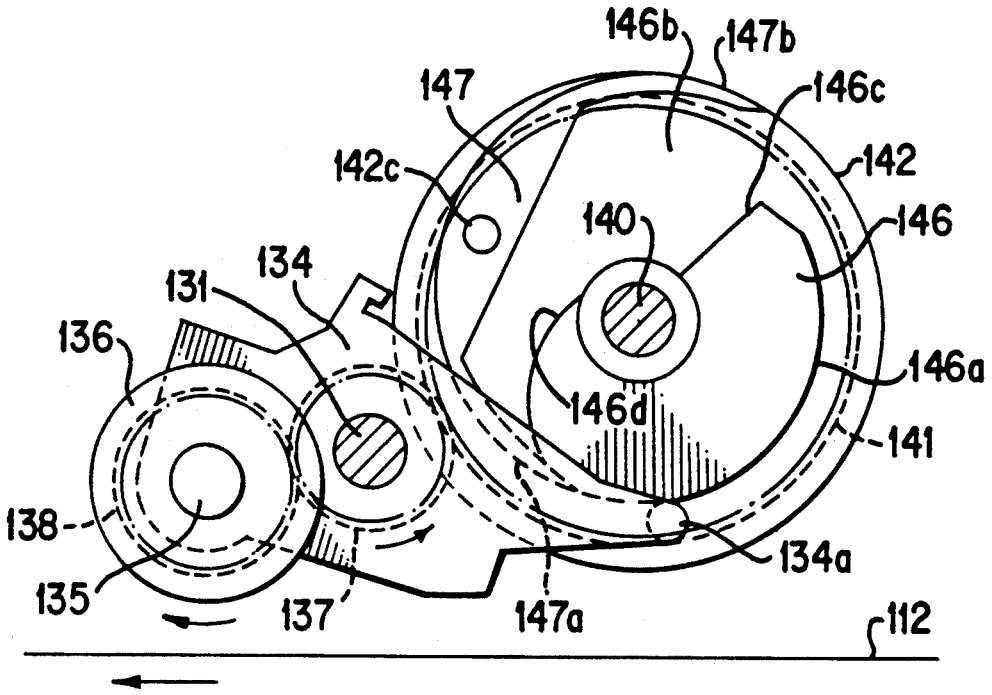
FIGS. 8(*a*) and 8(*b*) are views explaining the operation of the picking system of the present invention.
Figure 8B:
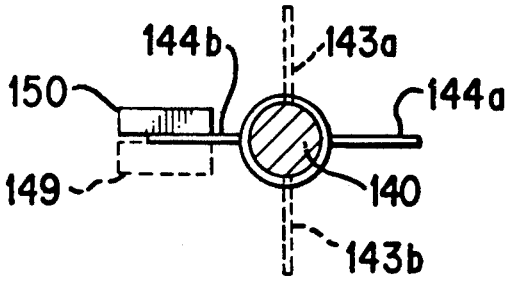
Figure 9A:
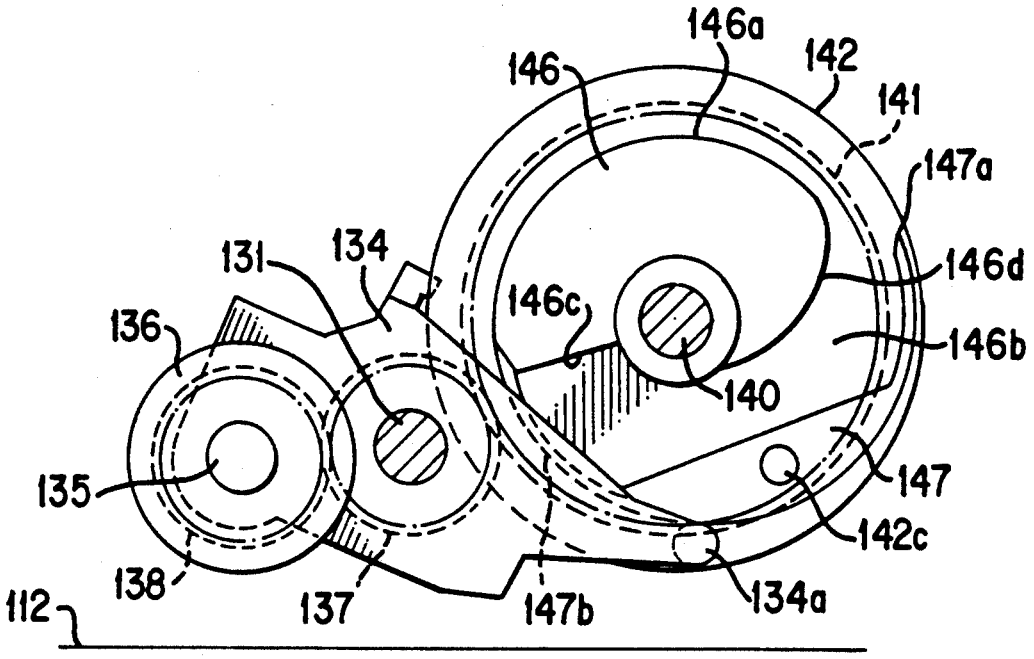
FIGS. 9(*a*) and 9(*b*) are views explaining the operation of the picking system of the present invention.
Figure 9B:
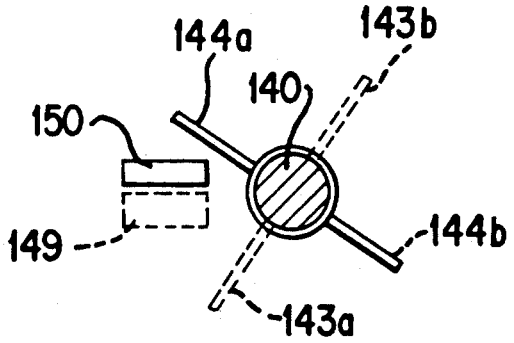
Figure 10A:
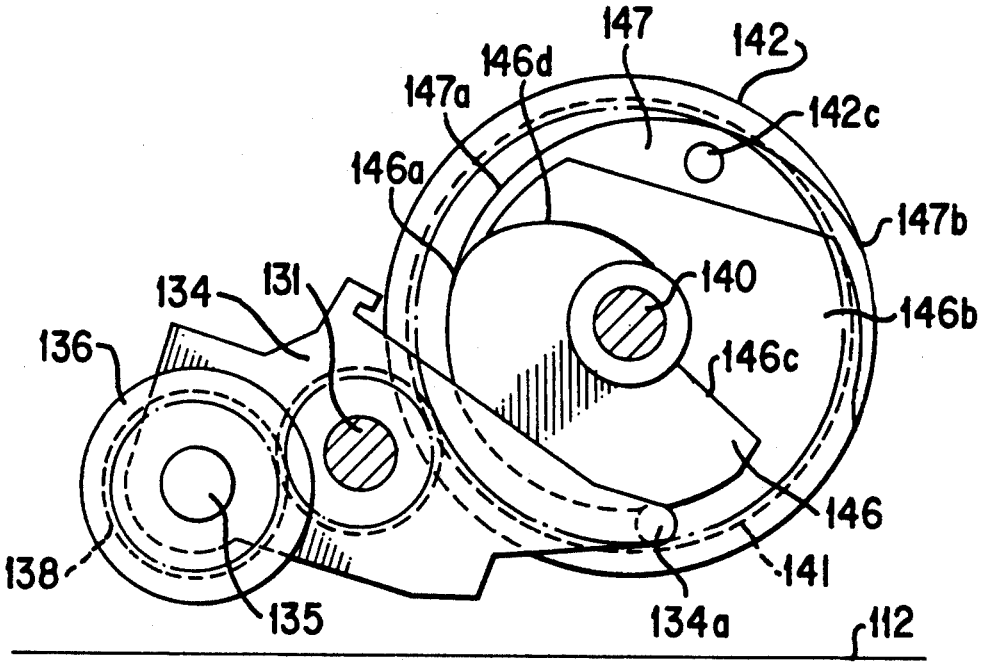
FIGS. 10(*a*) and 10(*b*) are views explaining the operation of the picking system of the present invention.
Figure 10B:
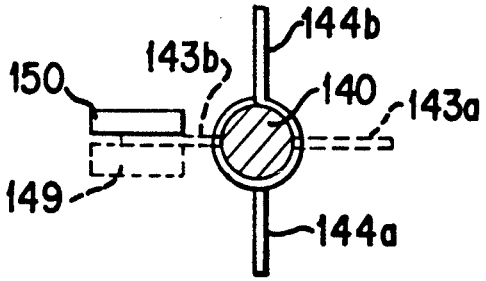

In operation, the cam wheel 142 in the state of FIG. 8(*a*) in the initial period or when printing is carried out. When the printing is carried out, the normal-reverse rotation motor 116 rotates in the normal direction (the normal turning direction is assumed to be one when the picking roller 136 is turned in the direction the paper is taken out) to rotate the rotating shaft 140 clockwise. At this state, the end portion 144*b* of the clutch spring 144 abuts to the stopper 150 to loosen the clutch spring 144 and as a result, both the clutch springs 143 and 144 are loosened and the rotating shaft 140 idly rotates in the state where the cam wheel 142 is blocked to rotate further. In this state, the cam follower 134*a* abuts to the upper face of the cam surface 146*a* of the main cam 146 and the picking roller 136 is separated from the paper 112 (a second position). This state is maintained until the printing is finished and until the next picking signal arrives.

When the picking signal arrives, the normal-reverse rotation motor 116 is reversely rotated. Then the rotating shaft 140 is rotated counter-clockwise to wind up the clutch spring 143 and the cam wheel 142 rotates together with the rotating shaft 140 (counter-clockwise in FIG. 8(*a*) and 8(*b*)). Then by the rotation of the cam wheel 142, the cam follower 134*a* rides on to the arm 147*a* of the auxiliary cam 147 from the 134*a* goes over the center of the swing of the auxiliary cam 147, the auxiliary cam 147 is swung clockwise around the pin 142*c* against the biasing force of the tension spring 148. By this swinging action, the arm 147*b* of the auxiliary cam 147 abuts to the upper face of the cam surface 146*a* at the falling edge 146*c* side (FIG. 9(*a*)) and the cam follower 134*a* rides on the upper face of the cam surface 146*a* through above the arm 147*b*. Then, when the end portion 143*b* of the clutch spring 143 abuts to the stopper 149, the cam wheel 142 is loosened and as a result, the both clutch springs 143 and 144 are loosened. Then the rotating shaft 140 idly rotates in the state where the cam wheel 142 is blocked to rotate further (FIG. 10(*a*)). At this time, the cam follower 134*a* will not fall to the recess 146*b*, so that the picking roller 136 is maintained at the position (a first position) separated from the paper 112. Accordingly, though the picking roller 136 is reversely turned during this time, it will not effect to the paper 112. Although the feed roller 106 is also reversely turned by the reverse rotation of the normal-reverse rotation motor 116, it causes no problem since the paper 112 is not on the position of the feed roller 106 at this time.

Figure 11A:
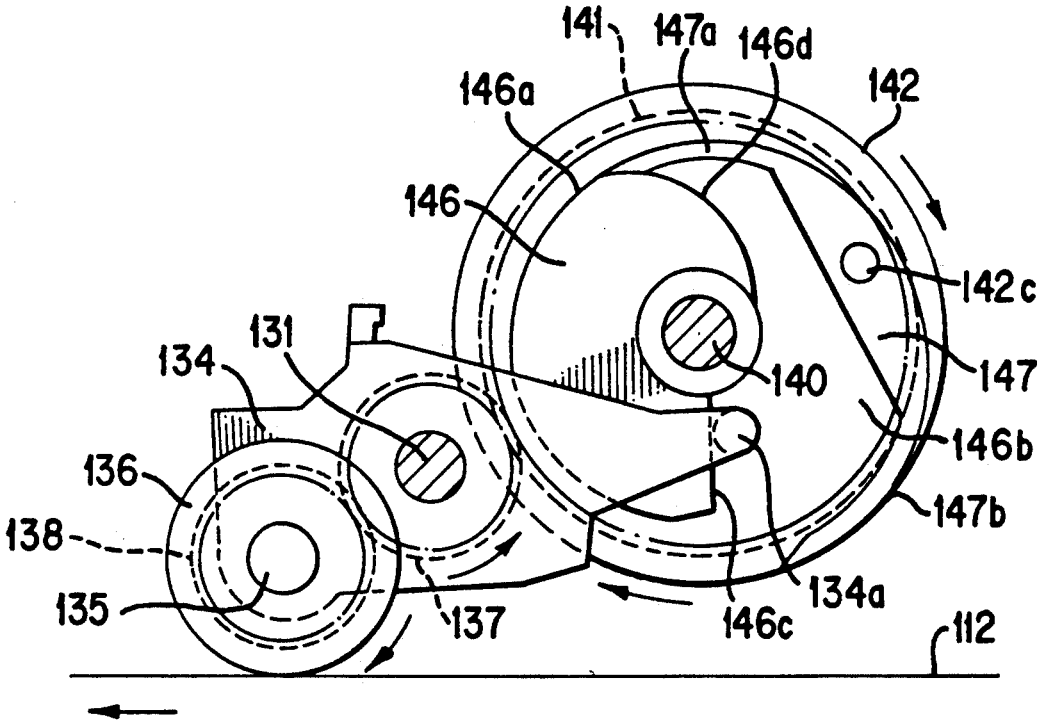
FIGS. 11(*a*) and 11(*b*) are views explaining the operation of the picking system of the present invention.
Figure 11B:
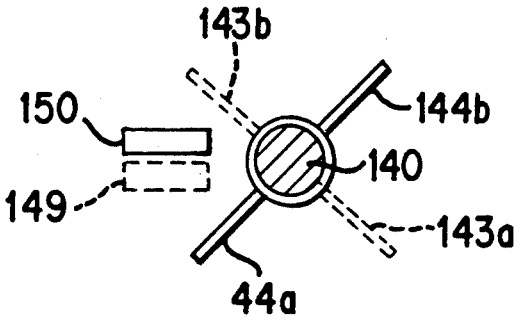
Figure 12A:
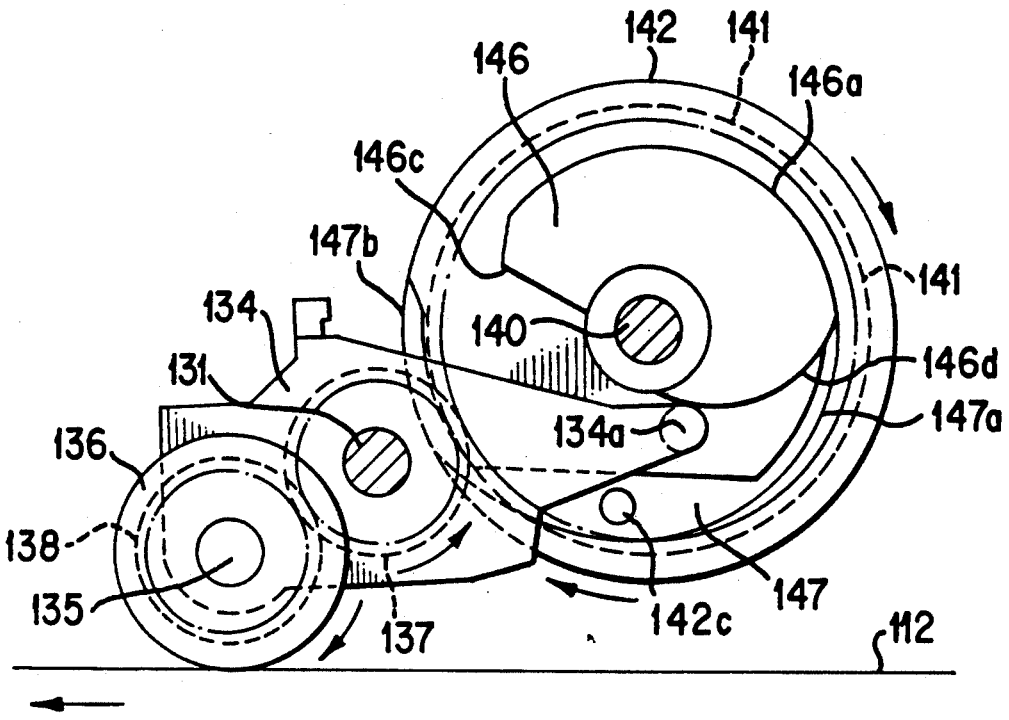
FIGS. 12(*a*) and 12(*b*) are views explaining the operation of the picking system of the present invention.
Figure 12B:
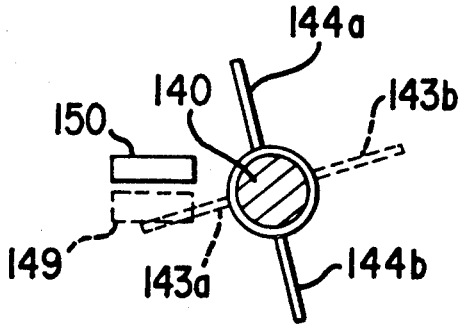
Figure 13:
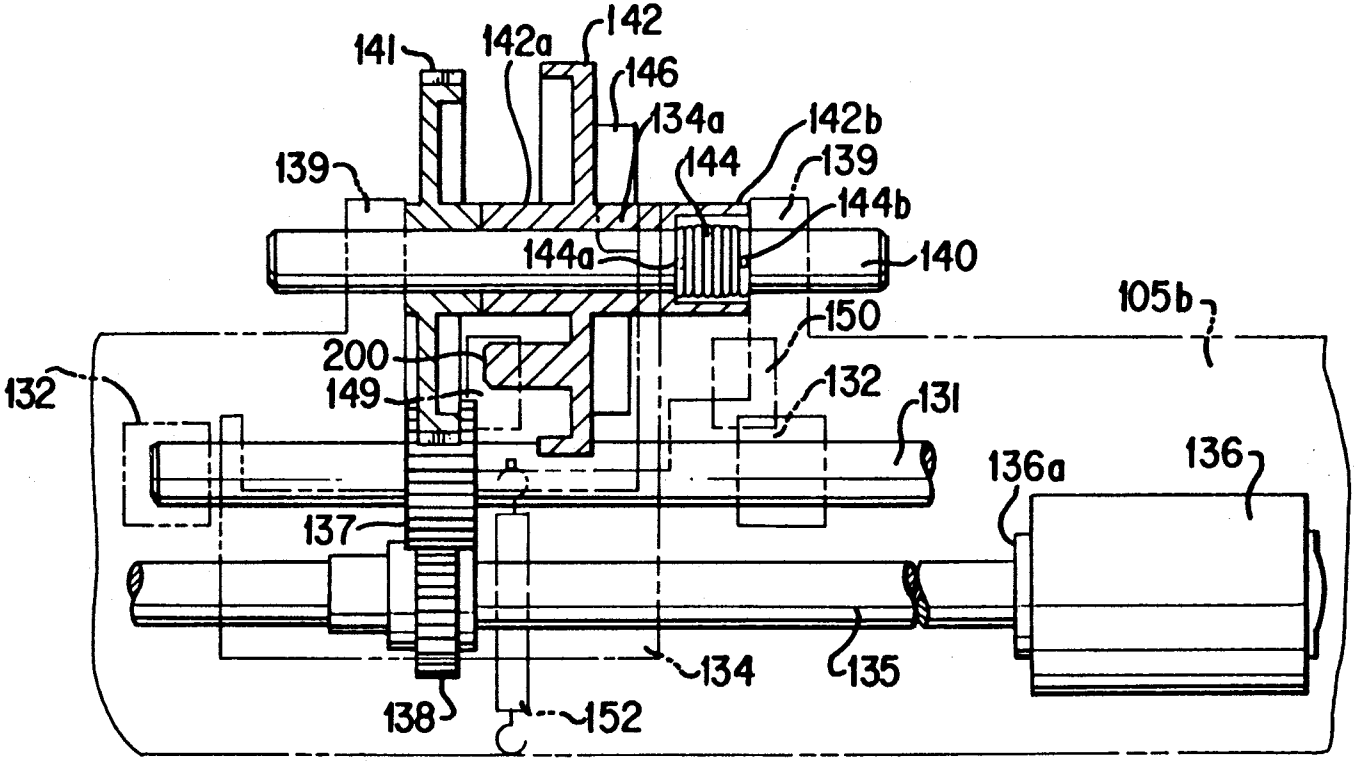
FIG. 13 is a plan view of the second embodiment of the picking system of the present invention.

When a certain time passes since the arrival of the picking signal, the normal-reverse rotation motor 116 is changed to turn normally. Then the rotating shaft 140 is rotated clockwise to wind up the clutch spring 144 and the cam wheel 142 rotates together with the rotating shaft 140 (clockwise in FIG. 10). Then the cam follower 134*a* moves on the upper face of the cam surface 146*a* by the rotation of the cam wheel 142 and falls to the recess 146*b* along the falling edge 146*c* going through between the arm 147*b* and the cam surface 146*a*. The picking roller 136 is then displaced to the position (the second position) where it abuts to the paper 112 as shown in FIG. 11(*a*). In the same time, the top paper 112 is taken out by the rotation of the picking roller 136. This action is continued until the cam follower 134*a* abuts to the easy sloped edge 146*d* (FIG. 12(*a*)) and the paper 112 is sent to the feed roller 106.

After abutting to the easy sloped edge 146*d*, the cam follower 134*a* climbs the easy sloped edge 146*d* and abuts to the arm 147*a* of the auxiliary cam 147 and rides on the upper face of the cam surface 146*a* while pushing up the arm 147*a* and going through between the arm 147*a* and the upper face of the cam surface 146*a*. In the state when the cam follower 134*a* rides on the upper face of the cam surface 146*a*, the end portion 144*b* of the clutch spring 144 abuts to the stopper 150. Then the clutch spring 144 is loosened and as a result, the both clutch springs 143 and 144 are loosened. The rotating shaft 140 then idly rotates in the state where the cam wheel 142 is blocked to rotate further. The state shown in FIGS. 8(*a*) and 8(*b*) is then maintained by that and printing is carried out in this state. The paper 112 sent to the feed roller 106 is conveyed between the printing head 110 and the platen 107 by the feed roller 106 and is printed by the printing head 110. After the printing, the paper 112 is discharged from the discharge port 120 by the discharge roller 108. Insertion and removal of the paper cassette 104 is carried out also in the state shown in FIGS. 8(*a*) and 8(*b*).

As described above, the picking roller 136 is tentatively abutted to the paper 112 to take out the paper 112 and is separated from the paper 112 after that in this embodiment, so that the paper 112 can be smoothly conveyed after being taken out. Or when the paper is not fed automatically by the picking roller 136 like when the paper 112 is manually supplied removing the paper cassette 104 or is manually supplied from the discharge port 120 reversely rotating the feed roller 106 and the discharge roller 108, the paper 112 can be smoothly supplied without being caught by the picking roller 136. In the later case of manually feeding papers, the paper 112 supplied from the discharge port 120 is tentatively sent to the side of the paper cassette 104 by the feed roller 106 and the discharge roller 108 and then conveyed by the feed roller 106 to between the printing head 110 and the platen 107 to be printed by the printing head 110. After the printing, the paper is discharged from the discharge port 120 by the discharge roller 108.

The rotation and displacement of the picking roller 136 are caused by the normal-reverse rotation motor 116 for feeding paper, so that no dedicated driving means needs to be provided and the cost can be lowered.

Figure 14:
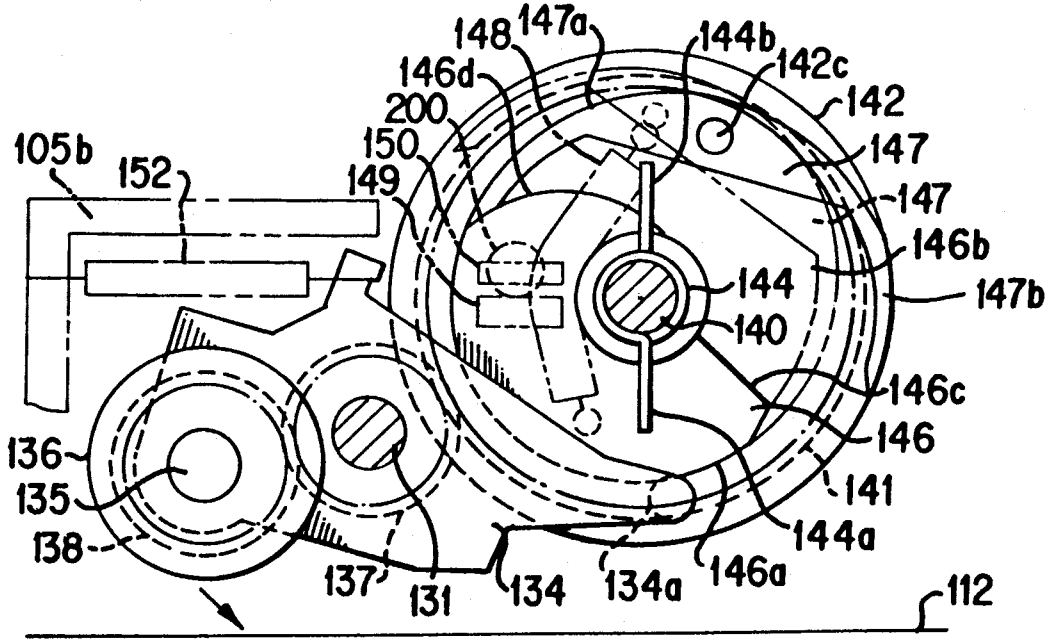
FIG. 14 is a right side view of the picking system of FIG. 13.

Although a pair of 143 and 144 are used in the aforementioned embodiment, it is possible to omit one clutch spring 143 and to provide an engage pin 200 on the cam wheel 142 so that the engage pin 200 abuts to the stopper 149 from above when the 142 rotates counter-clockwise in FIG. 14. In this case, the friction force of the rotating shaft 140 and the clutch spring 144 is set to be large so that the cam wheel 142 rotates together with the rotating shaft 140 even when the rotating shaft 140 is rotated counter-clockwise in FIG. 14. Thereby, when the rotating shaft 140 rotates counter-clockwise in FIG. 14, the cam wheel 142 rotates together with the rotating shaft 140. Then, when the engage pin 200 abuts to the stopper 149, the clutch spring 144 is loosened and the rotating shaft 140 idly rotates. On the other hand, when the rotating shaft 140 is rotated clockwise in FIG. 14, the clutch spring 144 is wound up to rotate the cam wheel 142 together with the rotating shaft 140 and when the clutch spring 144*b* of the clutch spring 144 abuts to the stopper 150 by the rotation, the clutch spring 144 is loosened and the rotating shaft 140 idly rotates.

Figure 15:
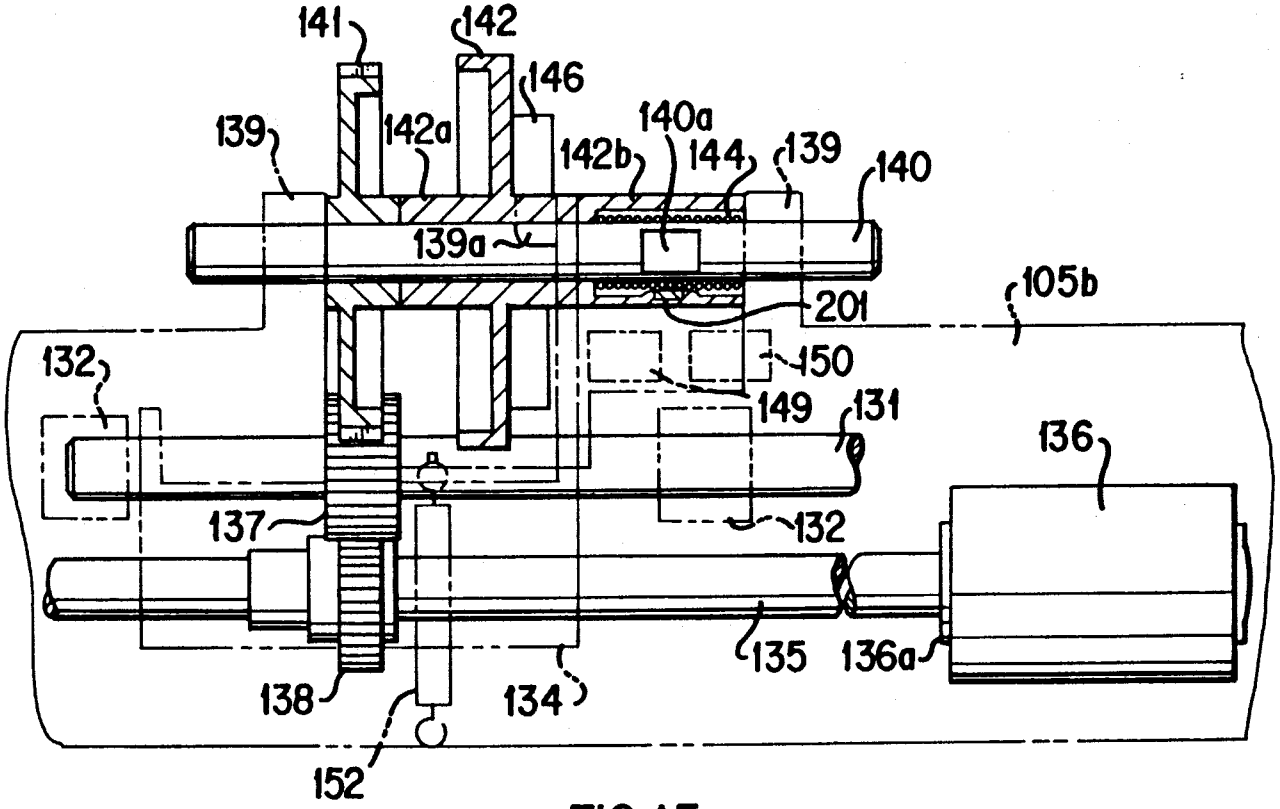
FIG. 15 is a plan view of the third embodiment of the picking system of the present invention.
Figure 16:
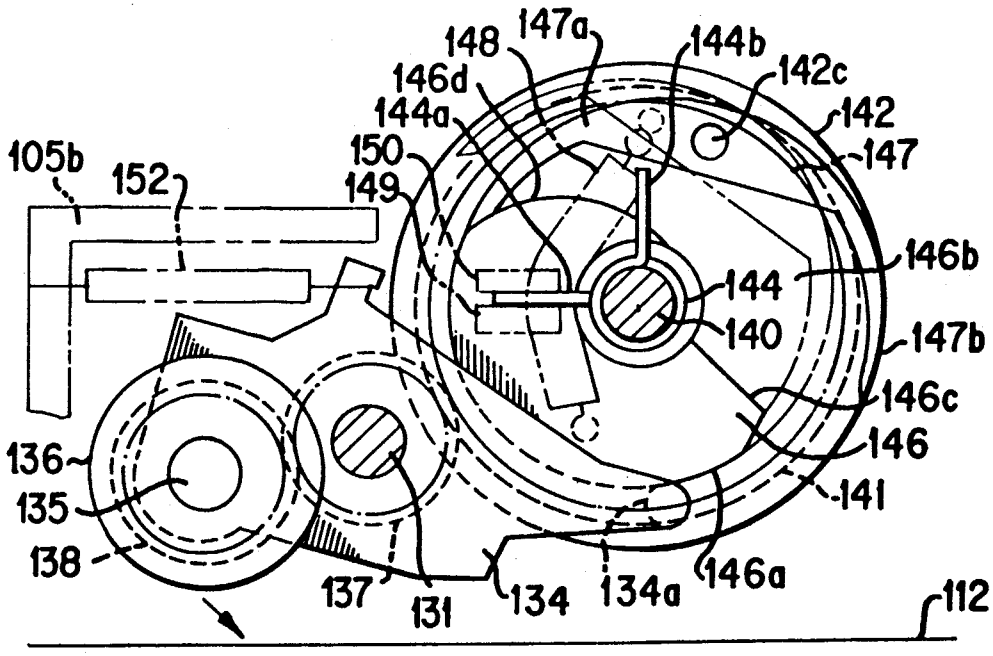
FIG. 16 is a right side view of the picking system of FIG. 15.

It is also possible to combine the middle portion of the clutch spring 144 to the inner circumference of the cam wheel 142*b* of the cam wheel 142 by adhesives 201 as shown in FIGS. 15 and 16 to abut one end portion 144*a* of the clutch spring 144 to the stopper 149 from above and to abut the other end portion 144*b* of the clutch spring 144 from below. The groove 140*a* for escaping the adhesives 201 is created on the rotating shaft 140. In this case, when the rotating shaft 140 is rotated counter-clockwise in FIG. 16, the side of the sleeve 142*a* is wound up bordering on the adhesive portion of the clutch spring 144 and the cam wheel 142 rotates together with the rotating shaft 140. And when the one end portion 144*a* of the clutch spring 144 abuts to the stopper 149 by the rotation, the side of the sleeve 142*a* is loosened bordering on the adhesive portion of the clutch spring 144 and as a result, the both sides of the adhesive portion of the clutch spring 144 is loosened and the rotating shaft 140 idly rotates. On the other hand, when the rotating shaft 140 is rotated clockwise in FIG. 16, the side of the cam wheel 142*b* is wound up boarding on the adhesive portion of the clutch spring 144 to rotate the cam wheel 142 together with the rotating shaft 140 and when the other end portion 144*b* of the clutch spring 144 abuts to the stopper 150 by the rotation, the side of the cam wheel 142*b* is loosened bordering on the adhesive portion of the clutch spring 144 and as a result, the both sides of the adhesive portion of the clutch spring 144 are loosened and the rotating shaft 140 idly rotates idly.

Figure 17:
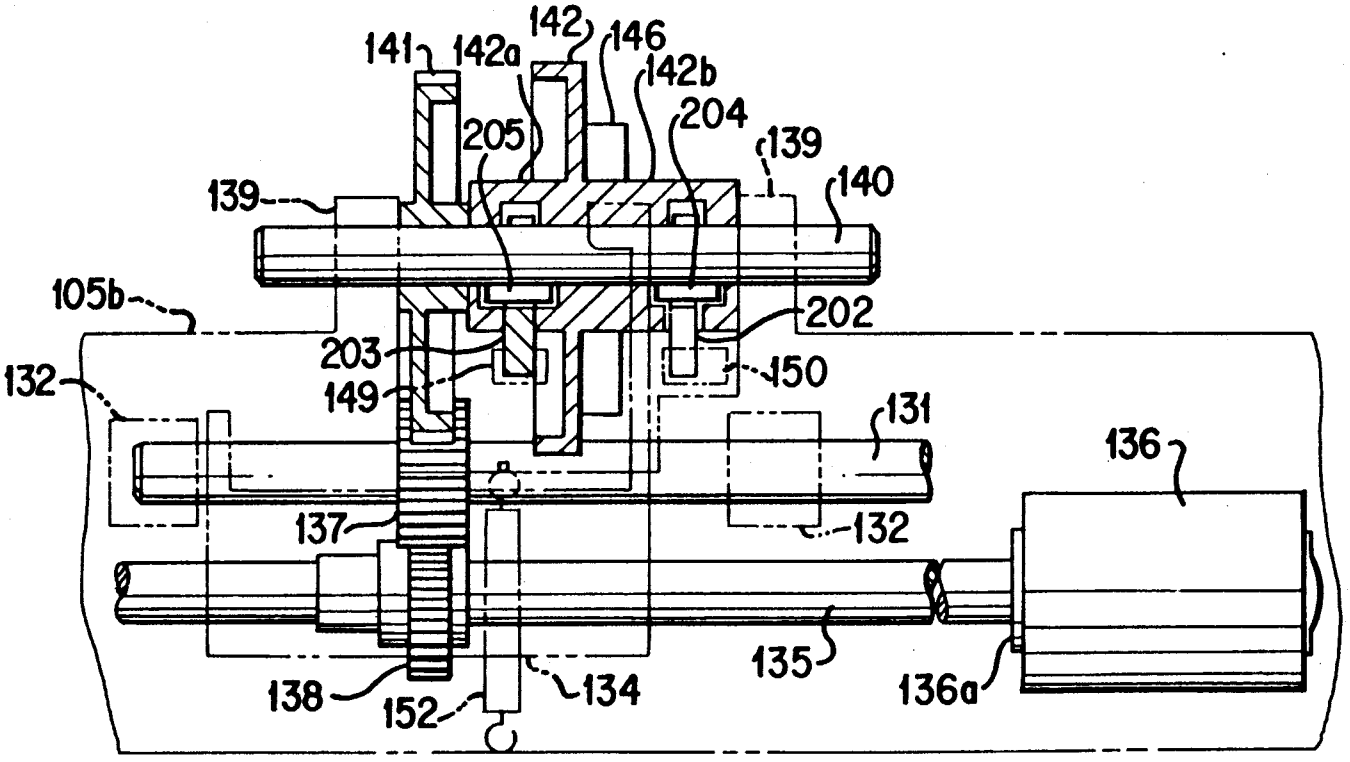
FIG. 17 is a plan view of the fourth embodiment of the picking system of the present invention.
Figure 18:
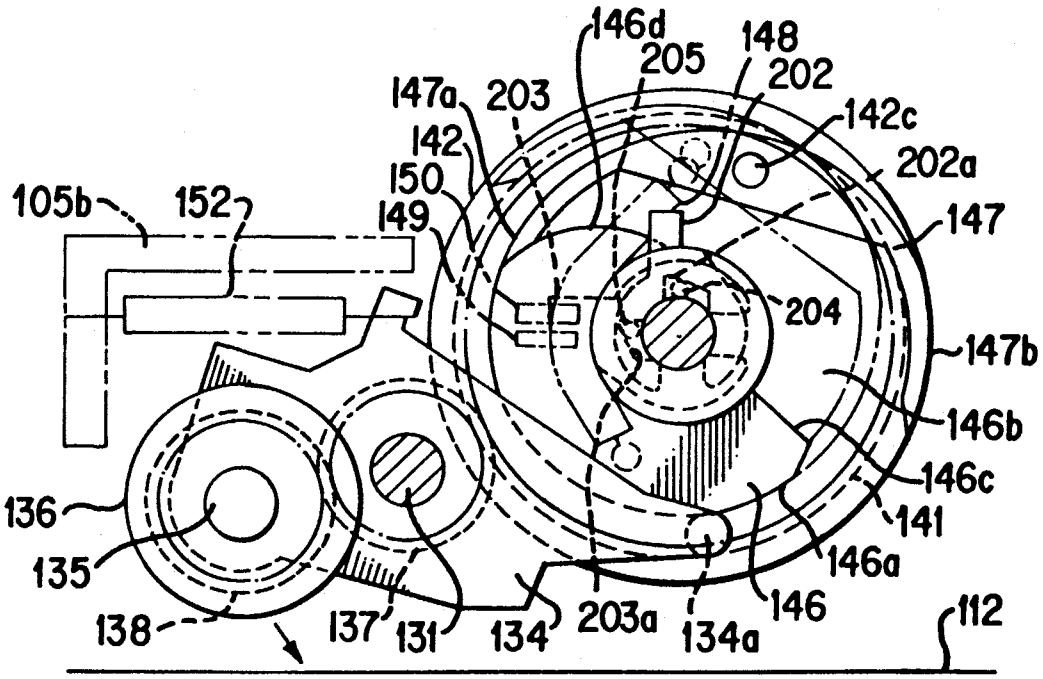
FIG. 18 is a right side view of the picking system of FIG. 17.

Also as shown in FIGS. 17 and 18, both of the pair of clutch springs 143 and 144 may be replaced by other clutching means.

In the clutching means shown in FIGS. 17 and 18, one end portions of the levers 202 and 203 are engaged to the rotating shaft 140 at the inside of the sleeve 142*a* and 142*b* of the cam wheel 142 in a manner relatively rotatable. The other end portions of the levers 202 and 203 penetrate through and are anchored to the sleeves 142*a* and 142*b* of the cam wheel 142 to rotate in one body with the cam wheel 142. The tip of the lever 202 faces to the stopper 150 at the outside of the sleeve 142*a* and is abutted by the stopper 150 from below when the cam wheel 142 is rotated clockwise in FIG. 18. On the other hand, the tip of the lever 203 faces to the stopper 149 at the outside of the cam wheel 142*b* and is abutted by the stopper 149 from above when the cam wheel 142 is rotated clockwise in FIG. 18. Moreover, notches 202*a* and 203*a* are created on the levers 202 and 203 at the engaging part with the rotating shaft 140 and rollers 204 and 205 are provided at the inside of the notches 202*a* and 203*a*. The notches 202*a* and 203*a* are provided with a size that allows to roll the rollers 204 and 205 in the peripheral direction of the rotating shaft 140. Moreover, the width of the notches 202*a* and 203*a* becomes gradually smaller from the one side toward the other side of the peripheral direction of the rotating shaft 140, the minimum width thereof is smaller than the diameter of the rollers 204 and 205 and they face the opposite directions each other. The rollers 204 and 205 can move in the peripheral direction of the rotating shaft 140 within the notches 202*a* and 203*a* while rolling by friction force with the rotating shaft 140 when the rotating shaft 140 rotates.

In this case, when the rotating shaft 140 is rotated clockwise in FIG. 18, the roller 204 moves in the peripheral direction of the rotating shaft 140 within the notch 202*a* of the lever 202, reaches to the narrow width portion of the notch 202*a* and cuts into between the lever 202 and the rotating shaft 140 to rotate the cam wheel 142 together with the rotating shaft 140. Then, when the projecting part of the tip of the lever 202 abuts to the stopper 150 from below, the roller 205 reaches to the wide width portion of the notch 202*a* and as a result, the both rollers 204 and 205 are positioned at the wide width portion of the notches 202*a* and 203*a* of the levers 202 and 203 to idly rotate the rotating shaft 140.

On the other hand, when the rotating shaft 140 rotates counter-clockwise in FIG. 18, the roller 205 moves in the peripheral direction of the rotating shaft 140 within the notch 203*a* of the lever 203, reaches to the narrow width portion of the notch 203*a* and cut into between the lever 203 and the rotating shaft 140 to rotate the cam wheel 142 together with the rotating shaft 140. Then, when the projecting part of the tip of the lever 203 abuts to the stopper 149, the roller 205 reaches to the wide width portion of the notch 203*a* of the lever 203 and as a result, the both rollers 204 and 205 are positioned at the wide width portion of the notches 202*a* and 203*a* of the levers 202 and 203 to idly rotate the rotating shaft 140.

Although the clutching means between the rotating shaft 140 and the cam wheel 142 has been provided by mounting the cam wheel 142 to the rotating shaft 140, it is possible to support the cam wheel 142 at a different region, to provide on the rotating shaft 140 a rotating wheel for transmitting rotation force to the cam wheel 142 and to provide a clutching means between the rotating wheel and the rotating shaft 140.

Also in the present invention, the cam surface of the main cam is a part where the moving track of the cam follower becomes far from the center of the rotation and the recess is a part where the moving track of the cam follower becomes closer to the center of the rotation. The main cam is not confined to have the structure as described in the above embodiments and various shapes of cam may be applied for the main cam.

The picking system of the present invention is not also confined to the printer having the aforementioned structure and is applicable to an electronic photo-recording system.

As described above, in the paper feeding system of the present invention, the picking rollers are separated from the paper except when the paper is fed and the paper is anchored by the corner nails and retained at a certain height position, so that a complex mechanism for stopping the rotation of the picking rollers when the paper is not fed becomes unnecessary and thereby the structure can be simplified and the cost can be lowered. There is also a gap between the picking rollers and the paper, so that the paper can be easily inserted or removed and the paper can be manually fed. Also no force that goes against feeding force of the picked paper acts, so that feeding accuracy is improved both in normal and reverse carriage returns. Also a large space for the paper to curl naturally during reverse carriage becomes unnecessary, so that the size of the system can be reduced.

Furthermore, the picking rollers drop down to the position where they press the paper when the paper is fed and the corner nails are in the degree just lightly placed on the paper, so that when the paper is fed, it can be easily curled, securely separated by a small curl and securely fed. Due to that, the spaces at the top and bottom can be smaller and a thin type system can be realized.

Still furthermore, in the picking system according to the present invention, the picking rollers can be separated from the paper in the paper holder, so that the paper can be smoothly conveyed without being dragged by the picking rollers when the paper is conveyed and papers can be manually supplied without providing a special paper feeding port to supply manually.

What is claimed is:

1. A picking system which contains picking rollers disposed facing against a paper holder and takes out a top paper from said paper holder by driving and rotating said picking rollers, comprising:

a lever that supports said picking rollers and is supported in a manner displacable;

a cam wheel which has cam means that engages with a cam follower provided on said lever and which displaces said lever so that said picking rollers are displaced to a first position where said picking rollers are separated from said paper and to a second position where said picking rollers abut to said paper;

driving means rotatable normally and reversely that rotates and displaces said picking rollers; and clutching means for transmitting the rotation of said driving means to said cam wheel by a certain rotation angle; and said cam means is comprised of;

a main cam comprising a cam surface for maintaining said picking rollers at said first position and a recess that allows said picking rollers to be displaced to said second position, and an auxiliary cam that allows said cam follower to fall from said cam surface to said recess when said driving means rotates normally, but blocks said cam follower from falling from said cam surface to said recess when said driving means rotates reversely.

2. The picking system according to claim 1, wherein an end portion at the head side of said cam surface of said main cam is created to be an easy sloped edge and an end portion at the opposite side thereof is created to be a falling edge and said auxiliary cam is swingably provided at said recess side of said main cam and is provided with a pair of arms that extend substantially in arc shape to the both sides of the center of the swinging, said auxiliary cam being biased by biasing means so that one said arm lies in row with said end portion at said easy sloped edge side of said main cam and other said arm is separated from said end portion at said falling edge side of said main cam.

3. The picking system according to claim 1 or 2, wherein said clutching means is comprised of:

a rotating shaft with which said cam wheel idly engages and which is rotated conjointly with said driving means;

a pair of clutch springs which are wound up to said rotating shaft and which rotate said cam wheel following to said rotating shaft; and a stopper member that abuts to an end portion of one said clutch spring when said cam wheel is rotated in one direction following to said rotating shaft to idly rotate said rotating shaft and that abuts to another end portion of another said clutch spring when said cam wheel is rotated to another direction following said rotating shaft to idly rotate said rotating shaft.

4. The picking system according to claim 1 or 2, wherein said clutching means is comprised of:

a rotating shaft with which said cam wheel idly engages and which is rotated conjointly with said driving means;

an engage pin which is provided on said cam wheel;

a clutch spring which is wound up to said rotating shaft and which rotates said cam wheel following to said rotating shaft; and a stopper member that abuts to an end portion of said clutch spring when said cam wheel is rotated in one direction following to said rotating shaft to idly rotate said rotating shaft and that abuts to said engage pin when said cam wheel is rotated to another direction following said rotating shaft to idly rotate said rotating shaft.

5. The picking system according to claim 1 or 2, wherein said clutching means is comprised of:

a rotating shaft with which said cam wheel idly engages and which is rotated conjointly with said driving means;

a clutch spring which is wound up to said rotating shaft and whose middle portion is fixed to an inner circumference of said cam wheel to rotate said cam wheel following to said rotating shaft; and a stopper member that abuts to one end portion of said clutch spring when said cam wheel is rotated in one direction following to said rotating shaft to idly rotate said rotating shaft and that abuts to another end portion of said clutch spring when said cam wheel is rotated to another direction following said rotating shaft to idly rotate said rotating shaft.

6. The picking system according to claim 1 or 2, wherein said clutching means is comprised of:

a rotating shaft with which said cam wheel idly engages and which is rotated conjointly with said driving means;

a pair of clutch levers which are idly engaged with said rotating shaft and which are engaged with said cam wheel;

a pair of rollers rollable in the peripheral direction of said rotating shaft following said rotating shaft between said clutch levers and said rotating shaft to rotate said cam wheel following said rotating shaft through one of said clutch levers when said rotating shaft rotates in one direction and to rotate said cam wheel following said rotating shaft through another of said clutch levers when said rotating shaft rotates in another direction; and a stopper member that abuts one of said clutch levers when said cam wheel is rotated in one direction following said rotating shaft to idly rotate said rotating shaft and that abuts another of said clutch levers when said cam wheel is rotated in another direction following said rotating shaft to idly rotate said rotating shaft.

* * * * *